US006766917B1

(12) United States Patent
Blewitt, III

(10) Patent No.: US 6,766,917 B1
(45) Date of Patent: Jul. 27, 2004

(54) CLOSURE WITH HINGED HOOK

(76) Inventor: John J. Blewitt, III, 6157 Mark Cir., Bensalem, PA (US) 19020

( * ) Notice: Subject to any disclaimer, the term of this patent is extended or adjusted under 35 U.S.C. 154(b) by 23 days.

(21) Appl. No.: 10/238,646

(22) Filed: Sep. 11, 2002

(51) Int. Cl.[7] ..... B65D 39/00
(52) U.S. Cl. ..... 215/252; 215/399; 220/751
(58) Field of Search ..... 215/252, 399, 215/253, 274, 262, 228, 305, 276, 200, 224; 220/212, 751, 755; 206/284; D9/216, 261, 439, 433, 503

(56) References Cited

U.S. PATENT DOCUMENTS

| | | | | | |
|---|---|---|---|---|---|
| 235,280 | A | * | 12/1880 | Norton | 220/212.5 |
| 1,289,947 | A | * | 12/1918 | Spender | 215/301 |
| 2,362,523 | A | * | 11/1944 | Armstrong, Jr. et al. | 215/399 |
| 2,635,604 | A | * | 4/1953 | Fredrickson | 604/403 |
| 3,240,384 | A | | 3/1966 | Lermer | |
| 3,495,797 | A | | 2/1970 | Ganz | |
| D226,839 | S | | 5/1973 | Jennings | |
| 3,866,782 | A | * | 2/1975 | Westfall | 215/253 |
| 4,373,632 | A | | 2/1983 | VanZandt | |
| D273,463 | S | * | 4/1984 | Morris | D9/443 |
| D282,053 | S | | 1/1986 | Paas | |
| D286,147 | S | * | 10/1986 | Carlson | D12/317 |
| 5,287,982 | A | * | 2/1994 | Tsai | 220/212.5 |
| 5,680,945 | A | * | 10/1997 | Sander et al. | 215/252 |
| 5,791,505 | A | * | 8/1998 | Gilliland | 215/228 |
| D403,242 | S | * | 12/1998 | Edwards | D9/529 |
| 5,938,054 | A | * | 8/1999 | Loader | 215/206 |
| 6,349,844 | B1 | | 2/2002 | Betras | |

OTHER PUBLICATIONS

Biesecker et al., Pub. US 2003/0136753, Jul. 24, 2003.*

* cited by examiner

*Primary Examiner*—Lien Ngo
(74) *Attorney, Agent, or Firm*—C. J. Husar, Esq.

(57) ABSTRACT

A closure having an integrally formed hook member that is received in a hook shaped recess on the upper surface of the closure when the hook member is in its stowed position. Release of the hook member is accomplished by applying an upward force on a release tab of the hook member permitting the hook member to spring into its operative position through a living hinge connection with the main body of the closure. The subject matter finds particular usefulness with the bottling industry, however, there are many other applications where it is desirable to provide suspension of its related container when not in use. The design of the closure is such that it can readily be accommodated by bottling machinery presently used in the bottling industry without any major modifications required.

14 Claims, 1 Drawing Sheet

CLOSURE WITH HINGED HOOK

BACKGROUND OF THE INVENTION

The invention relates generally to container closures and more specifically, it relates to bottle closures and containers having an integrally attached hook for convenient carrying of the bottle or container when not in use. The invention finds particular utility in today's ever increasing sporting population of joggers, bikers, walkers, hikers and a host of other organized team sporting activities. All of these activities increase the need for the individual participating in these activities to maintain their bodies hydrated and as a result of this requirement, water consumption during such physical activity has increased by leaps and bounds over the recent years to the point where annual sales of bottled water in the United States of America is now running at the billion dollar level and still on the rise.

In addition to the normal use of drinking water, the consumption of water during sporting activities, whether as a spectator or as a participant, has added to the overall consumption of drinking water. Although the invention has been described thus far with regard to the consumption of drinking water, the invention also finds usefulness with the various of types of sport related drinks such as colas, juices, energy burst drinks and the like as well as a multitude of uses other than bottles wherein hanging of the container is required or desirable when not in use.

The problems associated with bottles or containers that are not provided with hangers or hooks are many and obvious. We have all witnessed at one time or another a group of tourists walking the streets and taking in the sights carrying their water bottles or other drinks in one hand and when it comes to picture taking time, passing the bottles from one to another to allow use of both hands in the picture taking process. Or the visiting family with several kids and the person in charge carrying all the bottles while the children engage in carefree frolicking along their way.

The present invention provides a convenient means for each individual to carry their bottle or container by merely hooking it over a loop ring on one's backpack, belt, or any other suitable location, allowing free use of both hands while simultaneously providing ready access to the bottle when the need arises.

For purposes of this application, the term closure is used interchangeably with the term cap. As can be expected, a major design requirement for any such cap or closure would be a requirement that any modification, to enable hanging the bottle or container when not in use, would not interfere with the usual bottling, packaging, stacking or shipping of the product contained therein. Further, it is also desirable that the cap or closure retain its current configuration as closely as possible without any projecting or protruding elements that would interfere with normal handling of the bottle or container during packaging and not require any special modification to the bottle or container to accommodate the improved closure. As such, considerable effort has been expended in the design of the subject closure to satisfy these all important requirements while maintaining all the sealing and tamper evidence features presently found in the bottling industry.

DESCRIPTION OF THE PRIOR ART

A search of the U.S. Patent Office files in the appropriate Classes and subclasses revealed the following prior art:

U.S. Design Pat. No. 226,839—issued to Jennings on May 8, 1973, this patent discloses a combination closure and support hook, it is indicated to be a support hook for a collapsible tube, such as toothpaste. This hook is integral with the closure and extends a considerable distance above the closure upper surface.

U.S. Design Pat. No. 282,053—issued to Paas on Jan. 7, 1986, this patent also discloses a hook portion integrally formed on the upper surface of the closure.

U.S. Pat. No. 3,240,384—issued to Lermer on Mar. 15, 1966, this patent discloses a container with a cap thereon having an integral hook portion with a slit therein for ease in removing it from a display rod support.

U.S. Pat. No. 3,495,797—issued to Ganz on Feb. 17, 1970, this patent discloses a hanger attachment that slips over the closure of a collapsible tube container and includes a hook extending therefrom for hanging the tube when not in use.

U.S. Pat. No. 4,373,632—issued to VanZandt on Feb. 15, 1983, this patent discloses a nail polish bottle having a removable a sheath extending over the cap and having a central aperture therein through which the lowermost end of a hanger element extends and is secured thereto.

U.S. Pat. No. 6,349,844—issued to Betras on Feb. 26, 2002, this patent discloses a clip-type securing device that includes an opening for receiving a drinking container and is attached to the user's clothing until ready for use.

As can be seen from a close review of the above cited art, most of the known prior art devices are provided with hook members that are integrally formed on the uppermost surface of the closure and protrude upwardly therefrom and as such, they each include structure that would greatly interfere with the packaging and shipping of the products identified and set forth above.

Some of the other devices are after market attachments that are used in place of the original cap and attached to the threaded portion of the container to provide attachment means after purchase of the product. While yet another prior art device includes a strap-like member with a loop therein that is placed over the neck of the container and is provided with a clip portion at an opposite end for securement to one's person. None of the prior art disclosures are related to the bottling industry, which is the primary area of concern with the subject application.

SUMMARY OF THE INVENTION

The subject invention is directed primarily to bottle caps/closures that can readily be manufactured in a compact design that can be utilized with current bottling and packaging equipment presently used for the designated products and does not require reconfiguration of existing bottle or container configurations to accommodate the novel cap/closure. The usual sealing and tamper proof evidence features of the cap/closure are retained and not interfered with in any manner, thus providing a user-friendly cap/closure that does not require any after purchase modifications for its implementation.

OBJECTS OF THE INVENTION

An object of the invention is to provide a cap/closure that includes convenient attachment means for a bottle or container when not in use.

Another object of the invention is to provide a cap/closure that includes the usual sealing and tamper evidence features presently found on such caps/closures.

Yet another object of the invention is to provide a cap/closure that will not interfere with modem bottling and shipping practices.

Still another object of the invention is to provide a cap/closure that requires a minimum amount of reconfiguraton of presently used caps/closures.

A further object of the invention is to provide a user friendly cap/closure that includes an integral hook portion that can readily be activated from a stowed position to provide a hook/hanger for the container to which it is attached when not in use.

These and other objects of the invention will become more apparent hereinafter. The instant invention will now be described with particular reference to the accompanying drawings wherein like reference characters designate the corresponding parts throughout the several views.

DETAILED DESCRIPTION OF THE DRAWINGS

Figure 1:
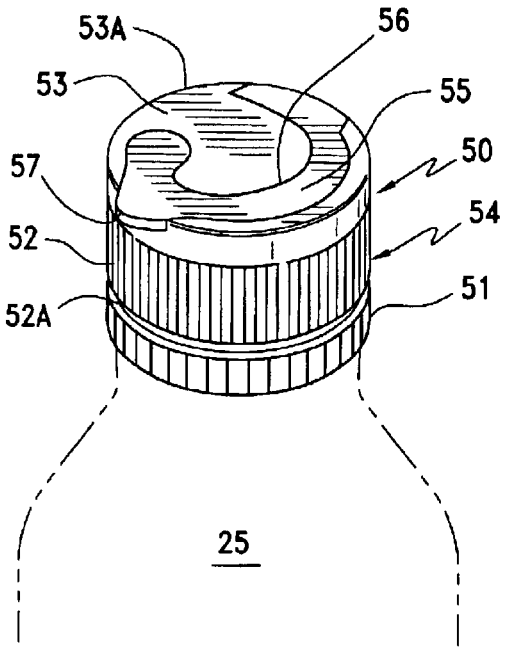
FIG. 1 is a perspective view of the novel cap/closure with the integral hook in its stowed position.

Referring now to FIG. 1, there is shown a bottle 25, shown in phantom, with the novel closure 50 installed thereon. Closure 50 includes a circular upper surface 53 with a peripheral edge 53A and a downwardly extending skirt portion 54 with the usual tamper evidence band 51 at the lowermost end thereof with a weakened breakline 52A therebetween. The outside circumference of closure skirt 54 includes a gripping surface 52 for gripping the closure 50 when releasing it from bottle 25. Uppermost surface 53 is shown with hook member 55 in its stowed position where it is received in a hook shaped recess 56 that accommodates hook member 55, thus providing a totally smooth upper surface 53 on closure 50. Hook member 55 is provided with a forward release tab 57 that extends slightly beyond the uppermost peripheral edge 53A of closure 50, thus providing a thumb engaging surface for raising hook member 55 into its operative position for hanging or attachment to any desired surface when not in use.

Figure 2:
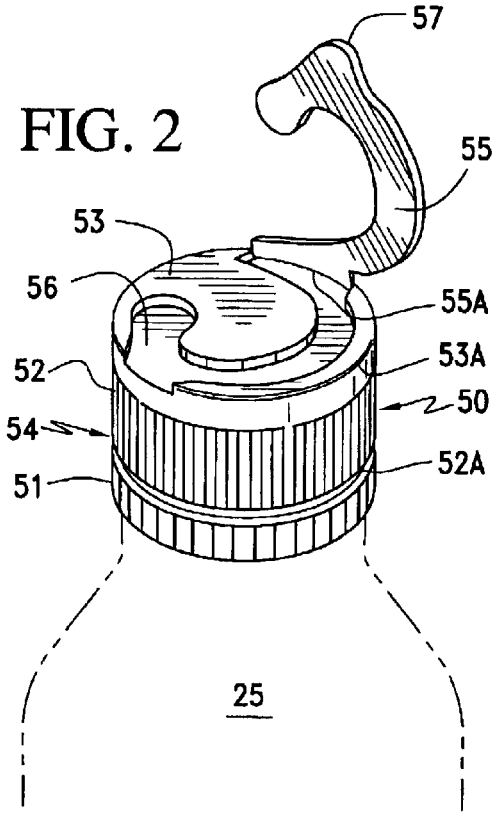
FIG. 2 is another perspective view similar to FIG. 1, illustrating the hook in its operative position.

Turning to FIG. 2, there is shown another perspective view similar to FIG. 1, however, in this view, hook member 55 has been raised to its operative position whereby the bottle 25 can be conveniently suspended. As is also shown, hook member 55 is connected to the main body of closure by a living hinge 55A that allows hook member 55 to be raised to its operative position as shown.

Figure 3:
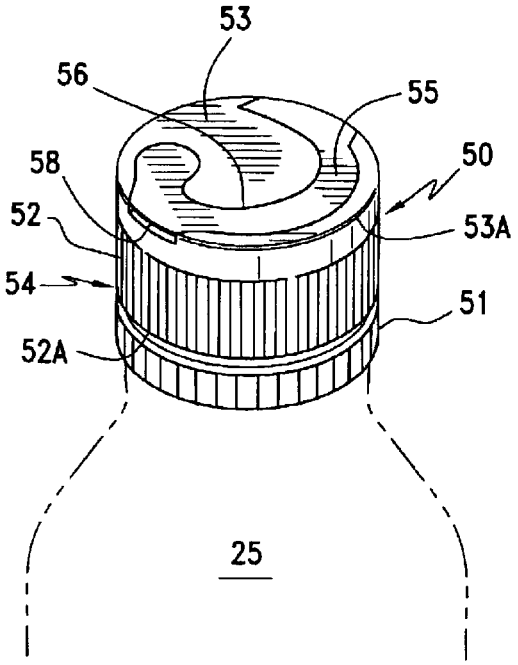
FIG. 3 is another perspective view, illustrating a modification of the hook release.

FIG. 3 is another view similar to FIG. 1, however in this view, forward release tab 57 has been replaced with a release slot 58, thus allowing the forwardmost portion of hook member 55 to conform to the uppermost outer circumference of closure 50 immediately above gripping portion 52. In this embodiment, one merely places a thumb fingernail in release slot 58 while holding the bottle 50 with the remainder of one's hand wrapped around the neck portion of bottle 25 and applying an upward force with the engaged fingernail and presto, hook member 55 is released from hook shaped recess 56 and hook member 55 springs into the position illustrated in FIG. 2 due to the presence live hinge 55A.

Figure 4:
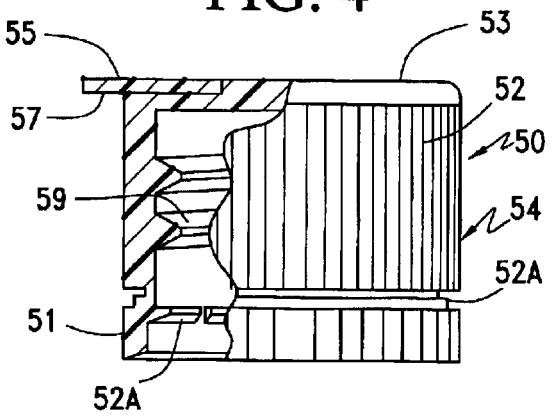
FIG. 4 is a cross sectional view of the embodiments shown in FIGS. 1 and 2.

FIG. 4 is a partial sectional view of the FIG. 1 embodiment with a portion of closure 50 broken away to illustrate the internal threads 59 that are used in screwing the closure 50 to the threaded portion of bottle 25. Additionally, the frangible breakline 52A is also shown, allowing the tamper evidence band 51 to remain on the neck of bottle 25 when closure 50 is twisted in the opening direction and frangible breakline 52A is broken to permit removal of closure 50.

Figure 5:
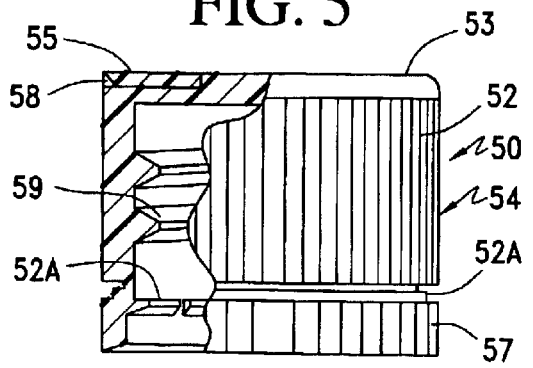
FIG. 5 is a cross sectional view of the embodiment shown in FIG. 3

FIG. 5 is a partial sectional view of the FIG. 3 embodiment, in this view, hook member 55 is shown as terminating flush with the uppermost vertical outer surface of closure 50. As illustrated, hook member 55 is provided with a release slot 58 allowing a user to apply a vertical force with a finger nail to the underside of hook member 55 at this point to release hook member 55 from its stowed position in hook shaped recessed portion 56. Due to the presence of living hinge 55A, hook member 55 will spring up to the position shown in FIG. 2, allowing bottle 25 to be suspended from any desired location.

It appears that a review of the subject invention and its various applications would be useful at this point. It is pointed out that applicant has provided a closure with an integrally formed hook member 55 located on its upper surface and stowed in a hook shaped recess 56 when not in use and is activated by the application of an upward force to the forward portion of hook member 55 allowing hook member 55 to spring into its release position through a live hinge 55A that connects hook member 55 to the main body of closure 50. The invention has been described with particular usefulness in the bottling industry, due its unique design features that allow accommodation by the presently used bottling equipment without any changes thereto. Further, particular reference was also made to the bottled water industry, however, there arc many other applications where it is equally useful since it can readily be utilized with other bottled or container products and the potential uses are limitless.

While the invention has been described with regard to its preferred embodiments, it is to be understood that the words that have been used are words of description rather than limitation and that changes may be made within the purview of the appended claims without departing from the full scope or spirit of the invention.

Having thus described my invention, I claim:

1. A screw closure for a container with an integrally formed hanger thereon, said closure comprising:

a circular upper surface forming the top of said closure with a peripheral edge and a depending skirt portion extending downwardly from said peripheral edge;

said skirt portion including internal threads and sealing surface and an outer gripping surface with a tamper evidence band at the lowermost end thereof and a weakened fracture line therebetween;

said circular upper surface having a recessed groove integrally formed in said upper surface; and hanger means comprising a hook portion having a base portion attached to said circular upper surface followed by an outwardly arcuately extending portion, which after reaching its apex, reverses its direction downwardly and inwardly and terminating after a limited distance to complete the hook leaving an open area extending from the terminating end to said base portion for ready attachment to a supporting member and received in said recessed groove when not in use and release means for releasing said hanger means thus allowing said hanger means to spring upward into its operative position whereby said hanger means is used to suspend the container to which it is attached thus providing a convenient hanger for said container when not in use.

2. A screw closure of the character defined in claim 1 wherein said closure is a bottle cap and said container is a bottle.

3. A screw closure of the character defined in claim 1 wherein said hanger means is a hook shaped member with a living hinge attached at one end to a base portion of said hook shaped member and the other end of said living hinge is attached to the peripheral edge of said container thus allowing said hanger means to be moved into its operative position or stowed in recessed groove when not in use.

4. A screw closure of the character defined in claim 3 wherein said closure is made of molded plastic.

5. A screw closure of the character defined in claim 1 wherein said release means includes a tab portion extending from said hanger means beyond the peripheral edge of said closure when in its stowed position whereby engagement of the undersurface of said tab portion with one's fingernail and applying an upward force thereto will readily release said hanger means into its operative position.

6. A screw closure of the character defined in claim 1 wherein said release means includes a release slot formed by an undercut on the underside of said hanger means allowing engagement with one's fingernail to release said hangers means from its stowed position.

7. A screw closure of the character defined in claim 1 wherein said recessed groove is dimensioned such that said hanger means is snugly received therein to frictionally hold said hanger means in its stowed position when inserted therein.

8. A screw closure of the character defined in claim 3 wherein said living hinge and said tab portion of said hanger means are disposed opposite to each other and in direct alignment on said hook-shaped member to provide a maximum release force when it is desired to release said hook-shaped member for hanging.

9. A screw-type closure of the character defined in claim 1 wherein said closure is a cap and the container is an article of manufacture wherein the hanger means is used for merchandise display.

10. A screw closure of the character defined in claim 1 wherein said closure has a flat upper surface and said closure is dimensioned to be compatible with currently used bottling equipment utilized in the bottling industry.

11. A screw closure of the character defined in claim 3 wherein said release means comprises an undercut on the forward underside of said hanger means to allow engagement with one's fingernail to release said hanger means into its operative position.

12. The combination of a bottle having a neck portion with external threads thereon and a bottle closure having internal threads that cooperate with said external threads of said bottle for securement thereto, said closure comprising:

a circular flat upper surface with a depending skirt portion including a fracturable tamper evidence band at the lowermost end of said skirt portion;

sealing means within said bottle closure on the underside of said flat upper surface for cooperating with the uppermost surface of said neck portion for sealing the contents within said bottle;

said closure further including hook means for hanging a container when mounted thereon and integrally formed on said upper flat surface;

said upper flat surface having a recessed groove therein for receiving said hook means when in its stowed position;

said hook means comprising a hook member having a base portion attached to said circular upper surface followed by an outwardly arcuately extending portion, which after reaching its apex, reverses its direction downwardly and inwardly and terminating after a limited distance to complete the hook, leaving an open area from the terminating end to said base portion for ready attachment and including a living hinge for connecting said hook member to said upper flat surface and release means at an opposite end thereof for releasing said hook member from said recessed groove into its operative position.

13. The combination of the character defined in claim 12 wherein said release means is a tab extending from the forward peripheral portion of said hook member whereby said tab can be engaged with one's fingernail and by applying an upward force thereunder, said hook member is released from said recessed groove into its operative position.

14. The combination of the character defined in claim 12 wherein said release means is an undercut slot in the forward peripheral portion of said hook member for engagement with one's fingernail to release said hook member into its operative position.

* * * * *